US006047627A

United States Patent [19]

Bueter

[11] Patent Number: 6,047,627

[45] Date of Patent: Apr. 11, 2000

[54] PISTON END DAMPENING

[75] Inventor: Josef Bueter, Haren/Altenberge, Germany

[73] Assignee: Buemach Engineering International B.V., Emmen, Netherlands

[21] Appl. No.: 09/235,532

[22] Filed: Jan. 22, 1999

[30] Foreign Application Priority Data

Mar. 4, 1998 [DE] Germany ..... 298 03 739 U

[51] Int. Cl.[7] ..... F15B 15/22

[52] U.S. Cl. ..... 91/395; 91/396; 91/405; 92/164

[58] Field of Search ..... 91/395, 396, 405, 91/406, 407, 408; 92/164

[56] References Cited

U.S. PATENT DOCUMENTS

| | | | |
|---|---|---|---|
| 4,048,905 | 9/1977 | Souslin | 91/405 |
| 4,207,800 | 6/1980 | Homuth . | |
| 4,425,836 | 1/1984 | Pickrell . | |

FOREIGN PATENT DOCUMENTS

| | | | |
|---|---|---|---|
| 2 206 410 | 8/1973 | Germany . | |
| 19 25 166 | 5/1978 | Germany . | |
| 905677 | 9/1962 | United Kingdom | 91/405 |

OTHER PUBLICATIONS

Publication No. 693765: Hydraulikzylinder Mit Endlagendaempfung.

*Primary Examiner*—F. Daniel Lopez
*Attorney, Agent, or Firm*—Michael J. Striker

[57] ABSTRACT

A pressure medium driven device has a cylinder having a cylinder tube, means forming a discharge outlet for a pressure medium, a piston movable in the cylinder over a stroke having a stroke end which is dampened by a counter pressure generated by throttling the pressure medium within a dampening area prior to its dissipation into the discharge outlet, a piston ring held between the piston end the cylinder in the dampening area and used as a throttle, a dampening sleeve provided in the cylinder for guiding the piston into an end position, the piston ring extending under the action of internal tension beyond a piston diameter and expanding to a maximum internal diameter of a cone, the dampening sleeve having an internal cone causing a progressive dampening, the piston ring having a slit with a minimal width in the cylinder tube, the dampening sleeve being provided in the dampening area with radial boreholes which duct the pressure medium into longitudinal slots from which it reaches the discharge outlet.

4 Claims, 4 Drawing Sheets

PISTON END DAMPENING

BACKGROUND OF THE INVENTION

The invention relates to a pressure driven device with a dampening feature at the piston end, especially that of a pneumatic or hydraulic working cylinder.

In accordance with IPC (International Patent Classification) pressure driven devices are classified under IPC F15B15/00, in which details for delaying the stroke are listed under IPC F15B15/22. A delaying or dampening of the stroke of a piston may be achieved by means of the pressure medium itself. The dampening force in such a case is achieved by an appropriate counterpressure on the piston which should preferably be proportional to the speed of movement of the piston. Beside an actively guided (controlled) pressure medium there is also a passive variation in which the pressure medium passes through a throttle. In such a case there is an approximately propolional relation between the pressure medium passing the through throttle and the pressure differential on both sides of the throttle. The factor of proportionality as a characteristic value is essentially determined by the geometry of the throttle.

The desired throttling effect should not commence until the stroke of the piston approaches the end position. Accordingly the flow conditions in the cylinder must change depending on the positioning of the piston within the cylinder, especially in relation to the end of stroke positioning. This may be achieved by different measures.

One possibility consists of changing the outlet, as described in the publication DE 2206410, in which the effective cross-section of the outlet is reduced by the entry of a forward projection of the piston. A known similar solution is embodied in publication DE1925166A, in which a part of several outlets arranged in a parallel configuration are blocked by the piston itself. By applying a suitable arrangement or dimensioning different dampening functions can be realised.

Another possibility is presented by providing a dampening space which is located in relation to the piston movement behind the actual outlet. On the piston advancing into the dampening space the only way of discharging the pressure medium located in the damper space to the actual discharge outlet is by passing through the throttle.

Based on the latter there are a multitude of executions known in which the throttle interconnects to the outlet by special channels which are incorporated into the piston or the cylinder. The utilisation of the free space between piston and cylinder as throttle is also known.

In accordance with publication DEGM6943765 the throttle itself is formed by means of an annular gap between the piston and the cylinder and causes the characteristic value in relation to the piston advancement to stay constant.

A known publication U.S. Pat. No. 4,425,836 utilises a helical recessing on the piston surface as a throttle. By the advance of the piston into the dampening space the characteristic values of the throttle geometry are changed in line with the effective length of the advance and increase in a linear manner to this. The linear increase of the characteristic value may be disadvantageous, unless constructively extensive helical structures and/or cross sections are implemented to facilitate variably increasing characteristic values.

The publication U.S. pat. No. 4,207,800 also refers to the application of a special dampening element which is arranged in the form of a ring between the cylinder and the piston (piston ring). On the front end it exhibits a multiplicity of radially open channels which are also capable of a slight axial shift and rests in the course of the throttling on the opposing annular tee slot of the piston, thus causing the pressure medium to flow through the throttling channels on its way to the outlet below and behind the throttle ring. The advantage of such a modular solution lies in the simple exchangeability of the throttle ring. The disadvantage of the solution lies in constant throttle characteristics in relation to the piston positioning.

SUMMARY OF THE INVENTION

The task of invention lies in the construction of a piston end dampening of the type described above in which a continuous characteristic throttle value in relation to the advance of the piston may be realised by a simple construction capable of being changed arbitrarily and simply.

In keeping with these objects and with others which will become apparent hereinafter, one feature of present invention resides, briefly stated, in a pressure medium driven device in which, for dampening of end of stroke, the cylinder in the stroke end positions is fitted by dampening sleeves which as part of the stroke guide the piston into the end positions, the internal tension behavior of the piston ring facilitates its extension beyond the piston diameter and the piston ring expands to the maximal internal diameter of the cone due to the internal tension of the piston ring, the internal cone of the dampening sleeve causes a dampening of progressive character to occur, the minimum width of the slit of the piston ring is achieved in the cylinder tube, and in the area of the dampening sleeve radial boreholes are provided which duct the pressure medium into the longitudinal slots from which it reaches a discharge outlet via a ring channel.

The essence of the invention comprises of the utilisation of the existing slit in a piston ring as the throttling element and the change of its effective opening in proportion to the advancement of the piston by changes in the internal diameter of the cylinder by means of a special sleeve.

Inventively the task is solved by arranging an exchangeable piston ring on the working piston of the cylinder which acts as a throttle cross section downstream which in the course of its movement towards the end of the working cylinder stroke of the passes through a bush which is conically executed to the inside diameter of cylinder with its front end which impedes the flow of the pressure medium by being positioned in a leakproof manner to the breach on the inside and thus causing the remaining pressure medium to flow through the slit of the piston ring in order to reach the downstream outlet via a ring channel and as well as the radial boreholes and longitudinal slots of the dampening sleeve which are interconnected.

The piston ring displays the smallest downstream cross section while moving in the cylinder tube or at the end of stroke position in the dampening sleeve. This involves the principle that the conical dampening sleeve at the end of stroke position has to correspond to the piston diameter. The conicity of the dampening sleeve is dimensioned such that the its front end engages the front end of the cylinder and thus by approaching the breach the dampening sleeve, or in the case of differential working cylinders the sleeves, are firmly fixed. With the movement of the working piston in the direction of the stroke end the piston ring mounted springs up radially in the area of the largest sleeve diameter due to its internal tension and thereby blocks the radial discharge boreholes thus forcing the discharge to take place in the manner described. In the course of the movement within the dampening sleeve, the slit in the piston ring is closed right up to the smallest outlet diameter. Due to the radial flexibility of the piston ring and the conicity of the dampening sleeve a moving closure of the outlet cross section is achieved. The dampening is a progressive function of the conical angle of the dampening sleeve.

The fundamental principle, as with all types of dampening, follows the mathematical formula $$\frac{m \cdot v^2}{2} = \int_0^s F_{Br} \cdot ds$$

The counterpressure is calculated as follows:

$$p_{Br} = p + v^2 \frac{\rho \cdot A_2^2}{2 \cdot A_{Dr}^2 \cdot \alpha}$$

In the formula shown the designations have the following meaning:

p=Counter-pressure against discharge $P_{Br}$=Dampening pressure m=Mass moved by the piston $\alpha$=Density of pressure medium v=Piston velocity at the commencement of dampening $F_{Br}$=Dampening force s=Dampening distance $A_{Dr}$=Throttle cross section $A_2$=Piston cross section The exchangeability of the piston ring and that of the conical dampening sleeve makes a change of the dampening characteristics possible in a simple manner and it becomes unproblematic to take special demands in individual applications into consideration. The preferred conicity of the dampening sleeve is envisaged within the limits of the conical angle from $\tan\alpha_{min}$=0.01 to $\tan\alpha_{max}$=0.04. The cone length in the dampening sleeve governs the length of the dampening distance. The dampening distance itself is a part of the total stroke.

In the named previously known cases an expensive manufacturing technology can generally be recognised and the element supporting the dampening cross section is predetermined whereas in this invention it varies in the course of the piston movement. The new solution in accordance with the invention is therefore characterised by the dampening cross section being incorporated into the moving system and by changing its value within the dampening distance up to the end of the stroke by which, given the easy exchangeability of the dampening parts, any desired dampening characteristic can be predetermined. In this manner a solution is provided which is simple to manufacture, but can be flexibly fitted to match dampening characteristics of applications which are independent for their effectiveness from the fluid used as pressure medium.

BRIEF DESCRIPTION OF THE DRAWINGS

The invention will be explained in more detail taking using an example of an execution. In this context.

DESCRIPTION OF PREFERRED EMBODIMENTS

Figure 1:
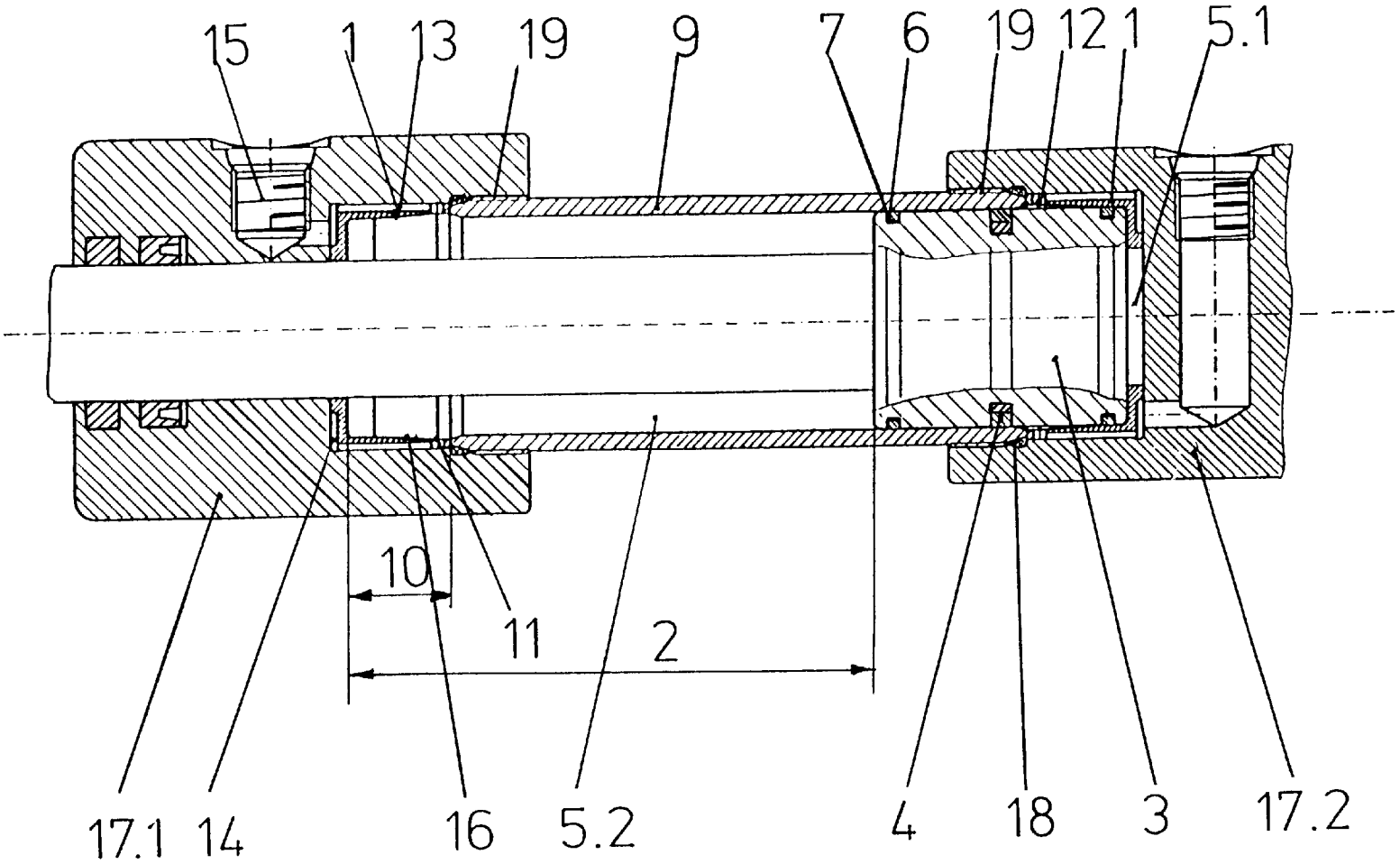
FIG. 1 is a differential working cylinder with dampening sleeves in the end of stroke areas.
Figure 2:
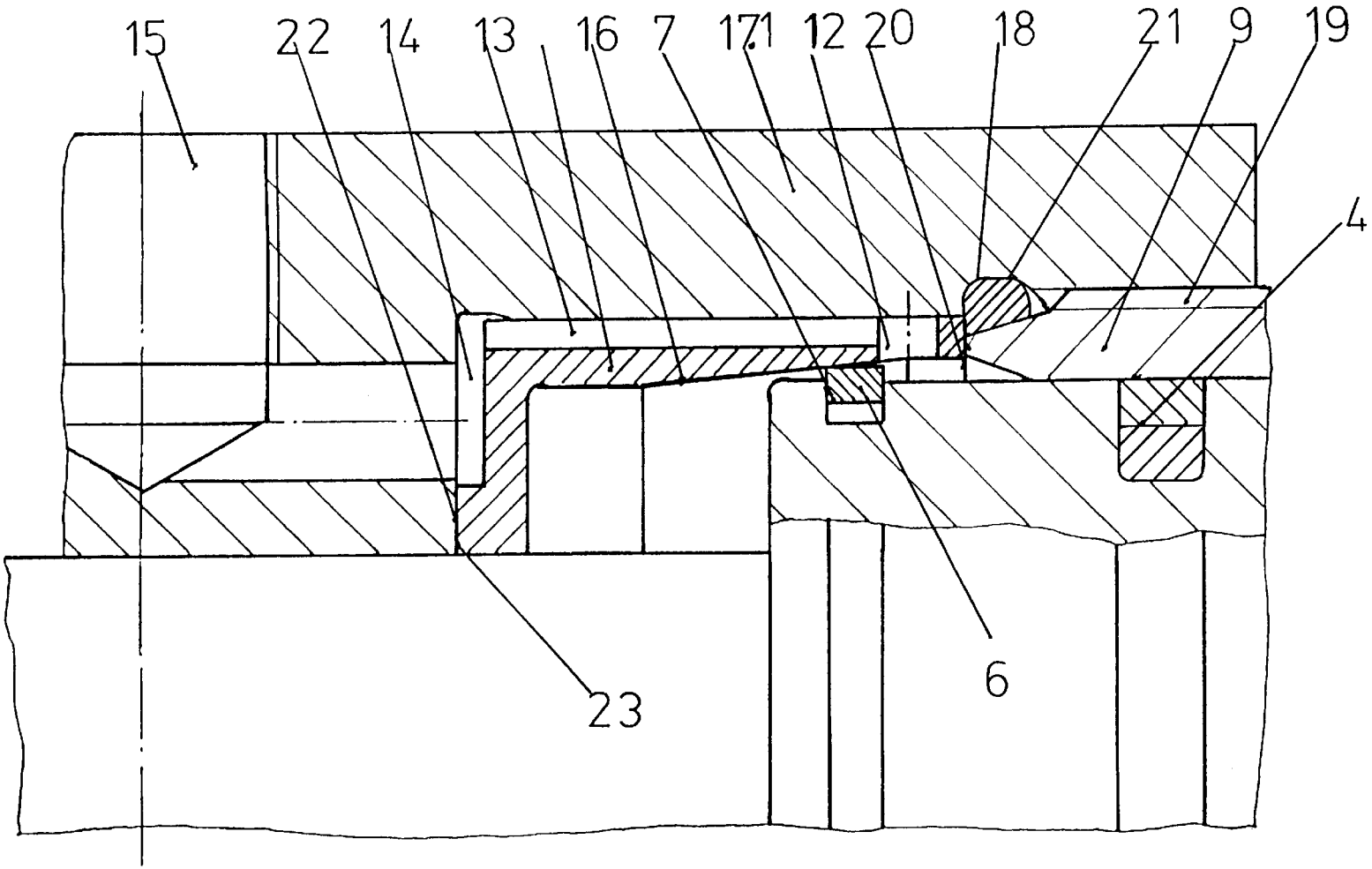
FIG. 2 is a section of the dampening space in the breach.
Figure 3B:
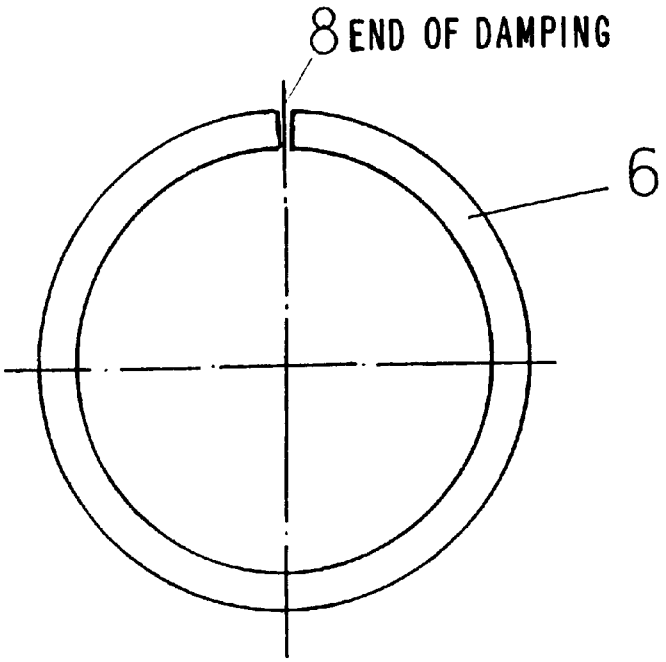
FIG. 3A and 3B is a piston ring.
Figure 3A:
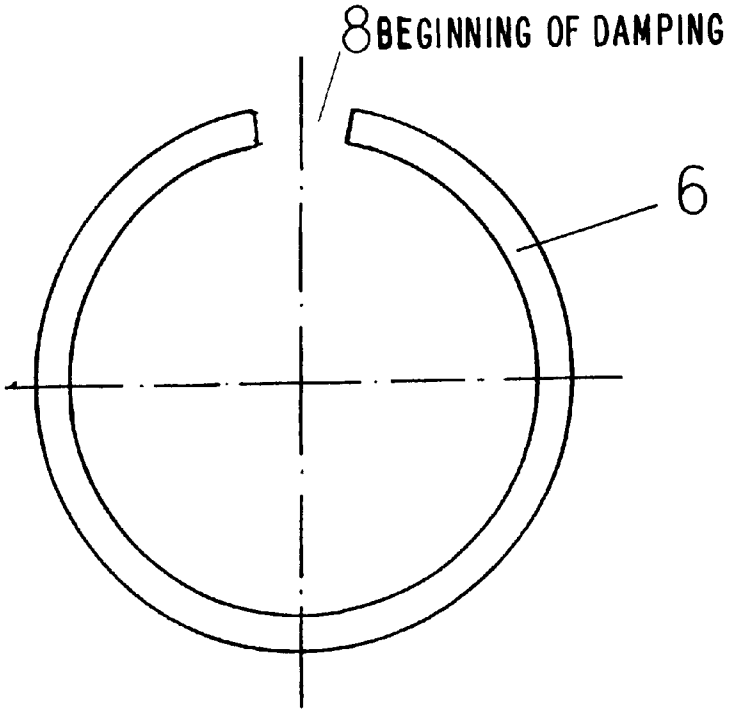
Figure 4B:
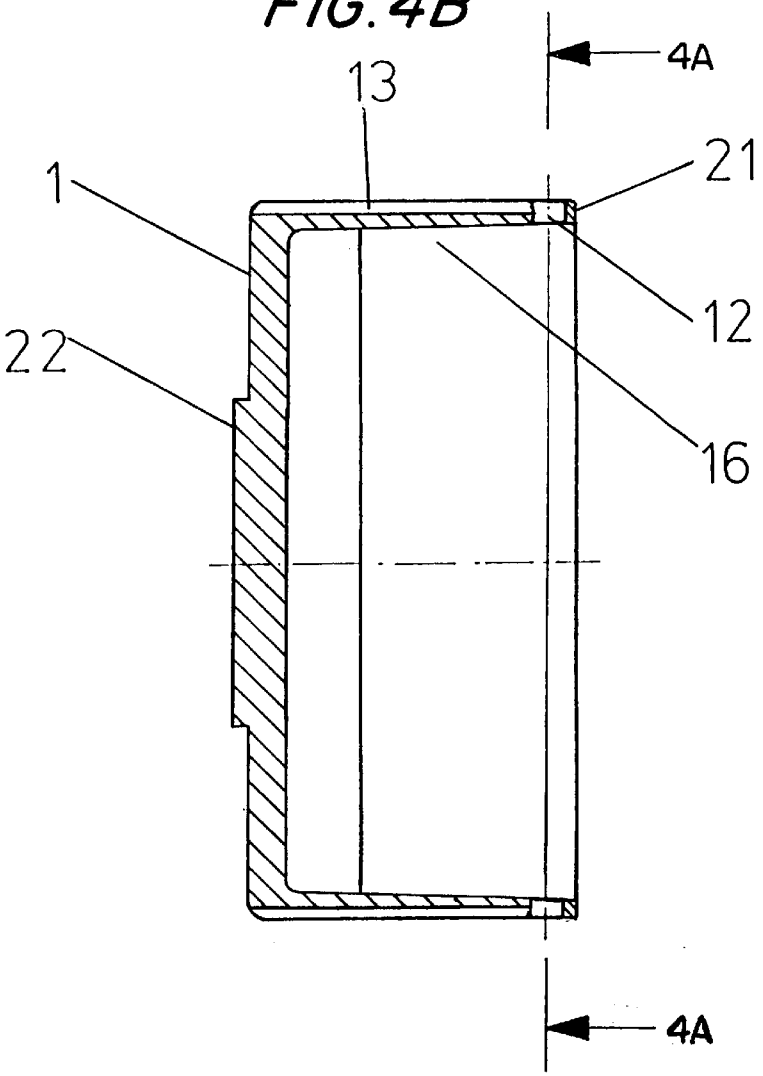
FIG. 4A and 4B is a dampening sleeve.
Figure 4A:
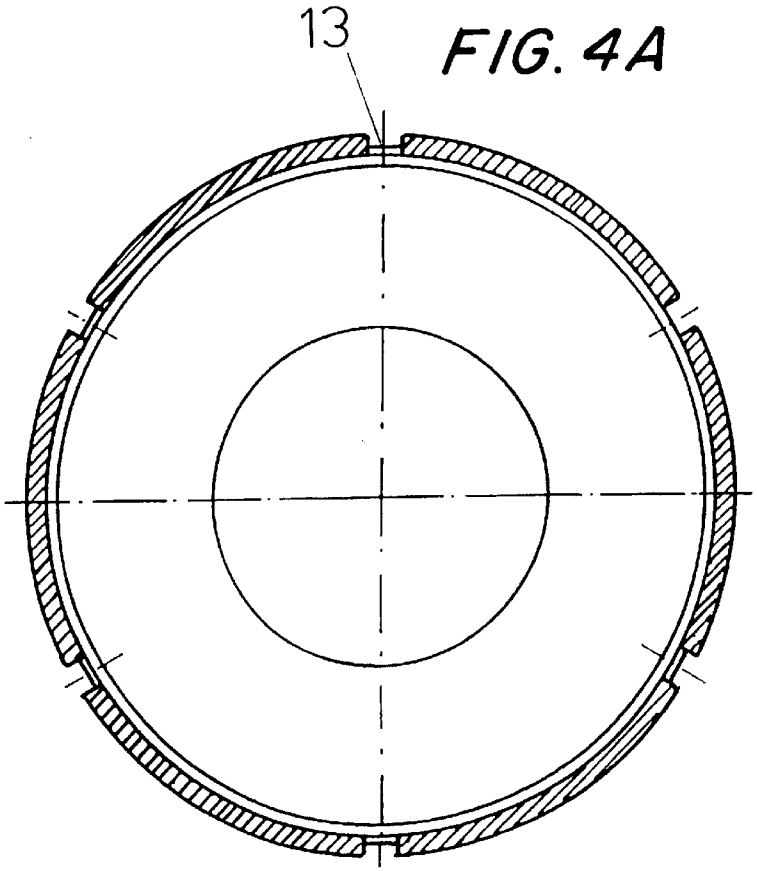

FIG. 1 shows in combination with the section FIG. 2, the detail of the piston ring as in FIG. 3 and the detail of the dampening sleeve as in FIG. 4 a differential working cylinder, which at the end of stroke positions is equipped with the dampening sleeves 1, which as components of the stroke 2, guide the piston 3 into the end of stroke area. By means of a gasket executed as a piston seal 4, the piston 3 separates the working area of the differential cylinder into the parts piston cavity 5.1 and ring piston cavity 5.2. The piston rings 6 are mounted on piston 3 and held by the slots 7 of piston 3 in such a manner that their internal tension behaviour facilitates their extension slightly beyond the diameter of the piston. For this reason the piston ring 6 is selected in such a way that it has the smallest slit 8 when it is guided in the cylinder pipe 9. Within a dampening area 10 the piston 3 is expanded radially in the course of the movement as a result of its own internal tension to the maximal internal diameter of the cone 11 of the dampening sleeve 1. Therefore, in the relaxed state, the piston ring 6 is always larger than the maximal internal diameter of the cone 11, to ensure that it fits along the stroke 2 tightened by tension to all internal diameters. In this area of the dampening sleeve 1, 12 radial boreholes are envisaged which duct the pressure medium into the longitudinal slots 13 from which it passes to the discharging outlet 15 by means of a ring channel 14. If piston ring 6 passes the position of the radial boreholes 12 the quantity of the pressure medium which is in front of piston 3 only discharged through the width of the slit 8 of the piston ring 6 which causes the dampening to commence which in the course of the movement of the piston 3 towards the end positions and as an effect of the internal cone 16 manifests itself as a dampening with a progressive character. The throttled pressure medium is discharged through the slit 8 and via the radial boreholes 12 and the longitudinal slots 13 reaching the ring channel 14 and in this manner the discharge outlet 15. To warrant the build-up of pressure in the differential working cylinder, the breaches 17.1 and 17.2 are both fitted with a gasket 18. The dampening sleeve 1 is braced by a threading 19 causing the front end 20 of the cylinder tube 9 to press against a front end of a dampening sleeve 21 as well as pressing with the external end 22 the internal surface 23 of the breach 17.1. The even surface quality of these areas ensures the stream of pressure medium does not reach the discharge outlet 15 in order to maintain the required counter-pressure in the piston ring space 5.2.

I claim:

1. A pressure medium driven device, comprising a cylinder having a cylinder tube; means forming a discharge outlet for a pressure medium; a piston movable in said cylinder over a stroke having a stroke end which is dampened by a counter pressure generated by throttling the pressure medium within a dampening area prior to its dissipation into said discharge outlet; a piston ring held between said piston and said cylinder in the dampening area and used as a throttle; a dampening sleeve provided in said cylinder for guiding said piston into an end position, said piston ring extending under the action of internal tension beyond a piston diameter and expanding to a maximum internal diameter of an internal cone, said dampening sleeve having said internal cone causing a progressive dampening, said piston ring having a slit with a minimal width in said cylinder tube, said dampening sleeve being provided in the dampening area with radial boreholes which duct the pressure medium into longitudinal slots from which it reaches said discharge outlet.

2. A pressure medium driven device as defined in claim 1, wherein said piston has a slot, said piston ring being held in said piston slot.

3. A pressure medium driven device as defined in claim 1; and further comprising a ring channel through which the pressure medium reaches from said longitudinal slots into said discharge outlet, said slit being formed so that the pressure medium passes through a width of said slit and then flows through said radial boreholes, said longitudinal slots, and said ring channel, into said discharge outlet.

4. A pressure medium driven device as defined in claim 1; and further comprising a breach; and a threading arranged so that said dampening sleeve is braced by said threading so that a front end of said cylinder tube presses against a front end of said dampening sleeve and causes it to press with an external frontal end against an internal surface of said breach, said surfaces have an even surface quality so that a stream of the pressure medium can not reach said discharge outlet by this route.

* * * * *